US010240492B2

(12) United States Patent
Noguchi et al.

(10) Patent No.: US 10,240,492 B2
(45) Date of Patent: Mar. 26, 2019

(54) VALVE OPENING/CLOSING TIMING CONTROL APPARATUS

(71) Applicants: AISIN SEIKI KABUSHIKI KAISHA, Kariya-shi, Aichi (JP); NIFCO Inc., Yokosuka-shi, Kanagawa (JP)

(72) Inventors: Yuji Noguchi, Obu (JP); Hiroyuki Hamasaki, Obu (JP); Youhei Mizuno, Yokosuka (JP)

(73) Assignees: AISIN SEIKI KABUSHIKI KAISHA, Kariya-Shi, Aichi (JP); NIFCO INC., Yokosuka-Shi, Kanagawa (JP)

( * ) Notice: Subject to any disclaimer, the term of this patent is extended or adjusted under 35 U.S.C. 154(b) by 100 days.

(21) Appl. No.: 15/374,341

(22) Filed: Dec. 9, 2016

(65) Prior Publication Data

US 2017/0198612 A1 Jul. 13, 2017

(30) Foreign Application Priority Data

Jan. 8, 2016 (JP) ..... 2016-002627

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/3443* (2013.01);
(Continued)

(58) Field of Classification Search
CPC ..... F01L 1/3442; F01L 1/047; F01L 2001/34426; F01L 2001/34479;
(Continued)

(56) References Cited

U.S. PATENT DOCUMENTS 6,394,715 B1 * 5/2002 Boyle ..... B23B 31/1074 408/238
9,004,025 B2 * 4/2015 Shinomiya ..... F01L 1/3442 123/90.17

(Continued)

FOREIGN PATENT DOCUMENTS

JP 2009-515090 A 4/2009
JP 2015-124643 A 7/2015

OTHER PUBLICATIONS

Office Action (Notification of Reasons for Refusal) dated Aug. 7, 2018, by the Japanese Patent Office in corresponding Japanese Patent Application No. 2016-002627, and an English Translation of the Office Action. (5 pages).

*Primary Examiner* — Zelalem Eshete
(74) *Attorney, Agent, or Firm* — Buchanan Ingersoll & Rooney PC

(57) ABSTRACT

There are provided a cylindrical portion in which a passage for feeding/discharging working fluid to/from a fluid pressure chamber is formed and which is disposed inside a driven-side rotary body, a bolt member that connects the driven-side rotary body to a cam shaft, a valve body body for regulating a flow direction of the working fluid relative to the fluid pressure chamber and a valve accommodating body that accommodates the valve body, the valve body and the valve accommodating body being disposed inside the cylindrical portion, and an urging portion provided on at least one of an upstream side and a downstream side of the valve accommodating body and configured to generate a repulsive force between an other object that regulates a position of the valve accommodating body and the valve accommodating body.

4 Claims, 7 Drawing Sheets

(52) U.S. Cl.
CPC ..... *F01L 2001/3444* (2013.01); *F01L 2001/34426* (2013.01); *F01L 2001/34433* (2013.01); *F01L 2001/34456* (2013.01); *F01L 2001/34469* (2013.01); *F01L 2001/34479* (2013.01); *F01L 2001/34483* (2013.01); *F01L 2101/00* (2013.01); *F01L 2250/02* (2013.01); *F01L 2810/04* (2013.01)

(58) Field of Classification Search
CPC ..... F01L 2001/3443; F01L 2001/34433; F01L 2001/3444; F01L 2001/34456; F01L 2001/34469; F01L 2001/34483; F01L 2250/00; F01L 2250/02; F01L 2810/04
See application file for complete search history.

(56) References Cited

U.S. PATENT DOCUMENTS

| | | | | |
|---|---|---|---|---|
| 2007/0095315 | A1 | 5/2007 | Hoppe et al. | |
| 2015/0075460 | A1* | 3/2015 | Mitsutani ..... | F01L 1/3442 123/90.15 |

* cited by examiner

VALVE OPENING/CLOSING TIMING CONTROL APPARATUS

CROSS REFERENCE TO RELATED APPLICATION

The application is based on and claims priority under 35 U.S.C. § 119 to Japanese Patent Application 2016-002627, filed on Jan. 8, 2016, the entire content of which is incorporated herein by reference.

TECHNICAL FIELD

This disclosure relates to a valve opening/closing timing control apparatus including a valve body and a valve accommodating body in a flow passage space formed inside a bolt member that connects a cam shaft and a driven-side rotary body.

BACKGROUND DISCUSSION

Japanese Unexamined Patent Application Publication (Translation of PCT Application) No. 2009-515090 (Patent Document 1) discloses an arrangement for use in a valve opening/closing timing control apparatus for an internal combustion engine, in which a control valve for controlling a feeding state of working fluid is provided inside a bolt member that connects a cam shaft and a driven-side rotary body. The control valve includes, in a flow passage space formed inside the bolt member, a check ball (a "valve body") and a valve housing (a "valve accommodating body") accommodating the check ball. The valve housing includes a filter for removing foreign substance contained in the working fluid. Fluid flowing in from the outer circumferential side of the bolt member is fed as flowing through the filter of the valve housing, thus pushing open the check ball. The valve housing is maintained in position relative to an opening of the bolt member by a ring-like stopper member.

SUMMARY

With the arrangement disclosed in Patent Document 1, the valve housing when exposed to vibration of the internal combustion engine may wobble in an axial direction inside the bolt member. Further, the valve housing when exposed to a pressure of the fluid entering the bolt member may move toward the opening side of the bolt member, whereby foreign substance included in the working fluid may pass a gap formed between the inner face of the bolt member and the outer face of the valve housing to eventually enter the valve portion. Such foreign substance may cause increase of friction between components in a feeding destination of the fluid and/or malfunction of the components, and so on. Moreover, if the valve housing is moved to result in repeated collision with the bolt member, an end portion of this valve housing will wear or be damaged, thus causing reduction in the durability of the valve housing.

In view of the above-described state of the art, there is a need for a valve opening/closing timing, control apparatus that can, appropriately hold a valve accommodating body that is disposed in a flow passage space formed in a bolt member.

According to a characterizing feature of a valve opening/closing aiming control apparatus, the apparatus comprises:

a driving-side rotary body that is rotated in synchronism with a crank shaft of n interne combustion engine;

a driven-side rotary body that is disposed coaxially with a rotational axis of the driving-side rotary body and that is rotated in synchronism with a cam shaft of the internal combustion engine;

a fluid pressure chamber formed between the driving-side rotary body and the driven-side rotary body, and configured to change a relative phase between the driving-side rotary body and the driven-side rotary body by feeding/discharging of working fluid;

a bolt member having a tubular portion that forms a passage for feeding/discharging the working fluid to/from the fluid pressure chamber and that is disposed inside the driven-side rotary body, the bolt member connecting the driven-side rotary body and the cam shaft; and a valve body and a valve accommodating body that are disposed inside the tubular portion, the valve body being configured to regulate a flow direction of the working fluid relative to the fluid pressure chamber, the valve accommodating portion being configured to accommodate the valve body;

wherein at least on one of an upstream side and a downstream side of the valve accommodating body, there is provided an urging portion for generating a repulsive force between an other object that regulates a position of the valve accommodating body and the valve accommodating body.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Next, an embodiment of this disclosure will be explained with reference to the Drawings.

[First Embodiment]

[Basic Arrangement]

Figure 1:
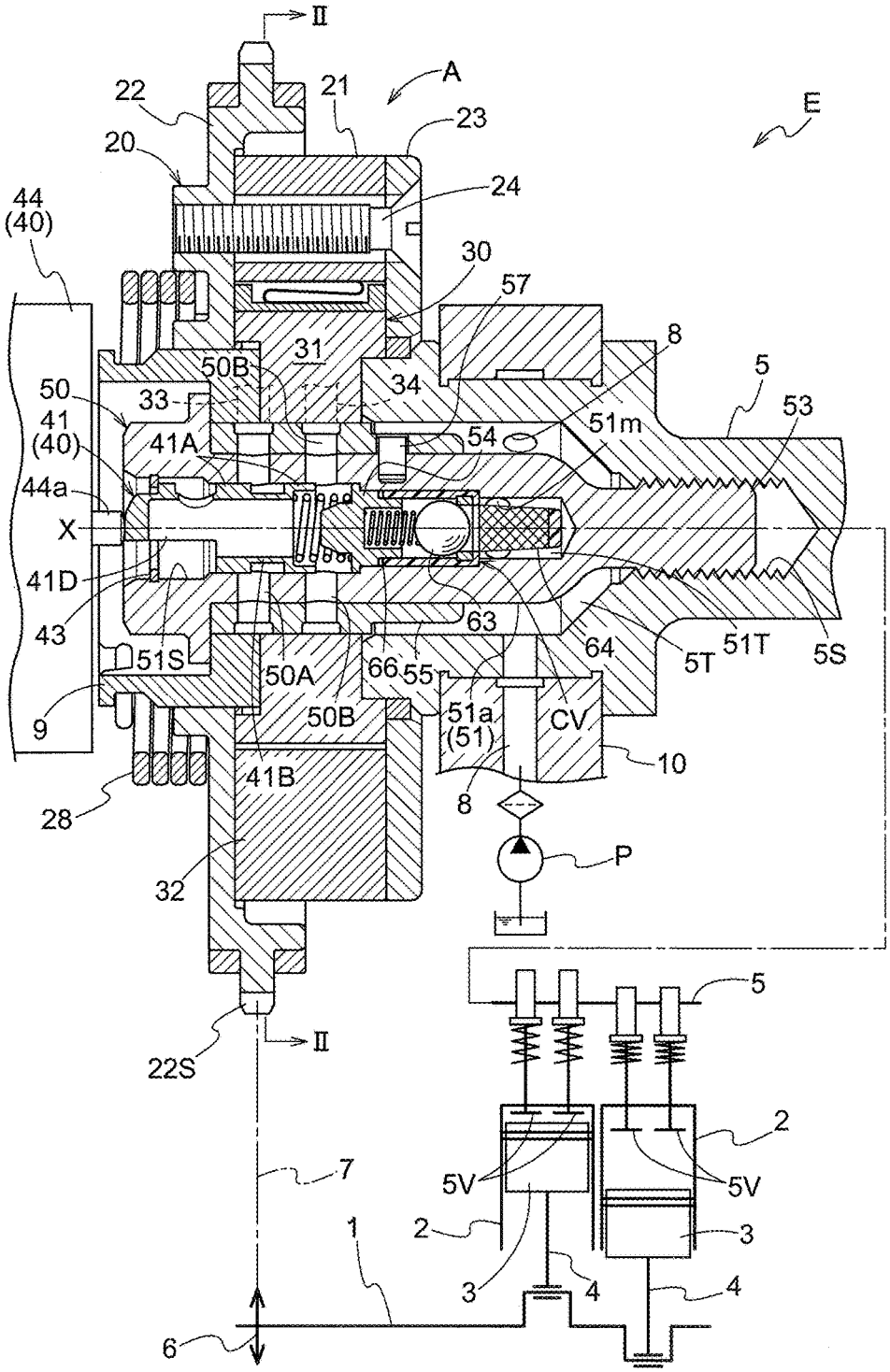
FIG. 1 is a section view showing a general arrangement of a valve opening/closing timing control apparatus.
Figure 2:
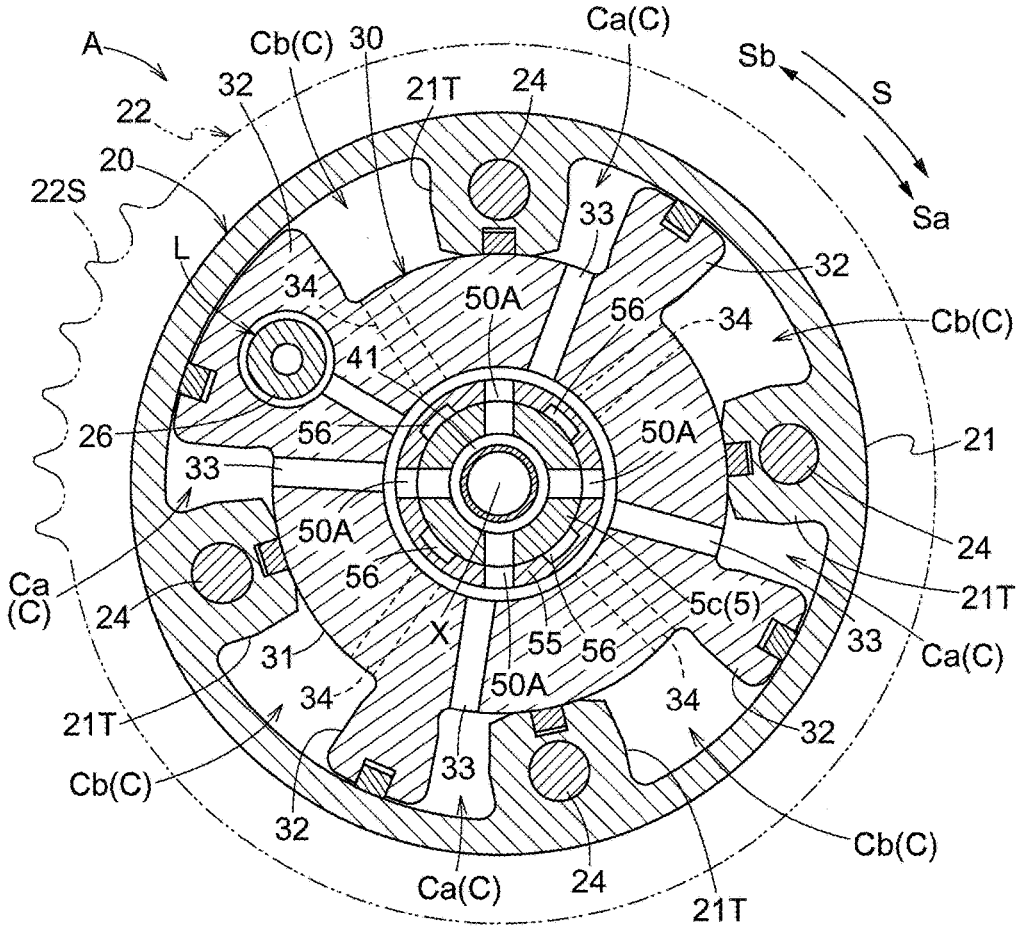
FIG. 2 is a section view taken along II-II in FIG. 1.

As shown in FIG. 1 and FIG. 2, a valve opening/closing timing control apparatus A is constituted by having an outer rotor 20 as a "driving-side rotary body", an inner rotor 30 as a "driven-side rotary body", and an electromagnetic control valve 40 for controlling working oil as "working fluid".

The inner rotor 30 (an example of the "driven-side rotary body) is disposed coaxial with a rotational axis X of an intake cam shaft 6 and is connected via threading engagement with the intake cam shaft 5 by a connecting bolt 50 to be rotatable therewith. The outer rotor 20 (an example of the "driving-side rotary body") is disposed coaxial with the rotational axis X and encases the inner rotor 30, thus being relatively rotatably supported to this inner rotor 30. The outer rotor 20 is rotated in synchronism with a crank shaft 1 of an engine E as an "internal combustion engine".

The electromagnetic control valve 40 includes an electromagnetic solenoid 44 supported to the engine E and includes also a spool 41 accommodated in a spool chamber 51S of the connecting bolt 50 and a spool spring 42.

The electromagnetic solenoid 44 includes a plunger 44*a* which is disposed coaxial with the rotational axis X to contact an outer end portion of the spool 41. By controlling electric power to be supplied to the solenoid therein, a protrusion amount of the plunger 44*a* is set, thereby to set an operational position of the spool 41. With this, the working oil (an example of "Working fluid") is controlled and by this control of the working oil, a relative rotational phase between the outer rotor 20 and the inner rotor 30 is set, thus realizing control of opening/closing timing of an intake valve 5V.

[Engine and Valve Opening/Closing Timing Control Apparatus]

FIG. 1 shows an example of the engine E (an example of the "internal combustion engine") to be included in a vehicle such as a passenger car or the like. The engine E is configured as a 4-cycle type engine in which a piston 3 is accommodated inside a Cylinder bore of a cylinder block 2 at an upper position and the piston 3 and the crank shaft 1 are connected to each other via a connecting rod 4. At an upper portion of the engine E, there are provided the intake cam shaft 5 for opening/closing the intake valve 5V and an unillustrated exhaust cam shaft.

An engine constituting component 10 rotatably supporting the intake cam shaft 5 defines a feed passage 8 for feeding working oil from a hydraulic pump P (an example of a "fluid pressure pump") driven by the engine E. The hydraulic pump P feeds lubricant oil reserved in an oil pan of the engine E as working oil (an example of "working fluid) to an electromagnetic control valve 40 via the feed passage 8.

A timing chain 7 is routed around an output sprocket 6 formed on the crank shaft 1 of the engine E and a timing sprocket 22S of the outer rotor 20. With this, the outer rotor 20 is driven to rotate in synchronism with the crank shaft 1. Incidentally, a sprocket is provided also at a front end of the exhaust-side exhaust cam shaft and the timing chain 7 is routed around this sprocket also.

As shown in FIG. 2, by a drive force from the crank shaft 1, the outer rotor 20 is driven to rotate to a direction of driving rotational direction S. The direction of rotation of the inner rotor 30 relative to the outer rotor 20 in the same direction as the driving rotational direction S will be referred to as an "advancing direction Sa", and its opposite direction will be referred to as a "retarding direction Sb", respectively. With the valve opening/closing timing control apparatus A, relation between the crank shaft 1 and the intake cam shaft 5 is set such that an intake air compression ratio is increased in association with increase of a displacement amount when the relative rotational phase is displaced to the advancing direction Sa, whereas the intake air compression ratio is decreased in association with increase of a displacement amount when the relative rotational phase is displaced to the retarding direction Sb.

Incidentally, in the first embodiment, the valve opening/closing timing control apparatus A is provided in the intake cam shaft 5. However, it is also possible to provide the valve opening/closing timing control apparatus A in the exhaust cam shaft or in both the intake cam shaft 5 and the exhaust cam shaft.

The outer rotor 20 includes an outer rotor main body 21, a front plate 22 and a rear plate 23, with these members being integrated to each other by fastening of a plurality of fastening bolts 24. In an outer circumference of the front plate 22, a timing sprocket 22S is formed. Also, in an inner circumference of the front plate 22, there is disposed an annular member 9 to be rotatable relative thereto. As a bolt head portion 52 of the connecting bolt 50 is pressure-fitted to the annular member 9, this annular member 9, an inner rotor main body 31 and the intake valve 5V are integrated together.

[Hydraulic Control Arrangement]

The outer rotor main body 21 integrally forms a plurality of protruding portions 21T protruding to the inner side in the radial direction. The inner rotor 30 includes a cylindrical inner rotor main body 31 that is in gapless contact with the protruding portions 21T of the outer rotor main body 21 and four vane portions 32 that protrude to the outer side in the radial direction from the outer circumference of the inner rotor main body 31 to come into contact with the inner circumferential face of the outer rotor main body 21.

With the above, the outer rotor 20 encases the inner rotor 30 and at intermediate positions of the protruding portions 21T adjacent each other in the rotational direction, a plurality of fluid pressure chambers C are formed on the outer circumferential side of the inner rotor main body 31. In operation, as the working oil is fed/discharged to/from the fluid pressure chambers C, relative phase between the outer rotor 20 and the inner rotor 30 is changed. These fluid pressure chambers C are partitioned from each other by the vane portions 32, thus forming advancing chambers Ca and retarding chambers Cb sectioned from each other. Advancing passages 33 communicated to the advancing chambers Ca are formed in the inner rotor 30, and retarding passages 34 communicated to the retarding chambers Cb are formed in the inner rotor 30.

As shown in FIG. 1, between the outer rotor 20 and the annular member 9, a torsion spring 28 is provided for assisting displacement of the relative rotational phase between the outer rotor 20 and the inner rotor 30 (to be referred to as the "relative rotational phase" hereinafter) in the advancing direction Sa by applying an urging force from a most retarded angular phase in the advancing direction Sa.

Further, a lock mechanism L is provided for locking (fixing) the relative rotational phase between the outer rotor 20 and the inner rotor 30 to the most retarded phase. The lock mechanism L includes a locking member 26 supported to be able to protrude/retract in the direction along the rotational axis X relative to one vane portion 32, a locking spring for urging the locking member 26 to cause this member 26 to protrude, and a locking recess formed in the rear plate 23. Incidentally, the lock mechanism L can include a locking member 26 that is guided to move in the radial direction.

The lock mechanism L functions such that upon arrival of the relative rotational phase at the most retarded phase, the locking member 26 engages in the locking recess under the urging force of the locking spring, thereby to maintain the relative rotational phase at the most retarded phase. Further, as the advancing passage 33 is communicated to the locking recess, upon feeding of the working oil to the advancing passage 33, with the pressure of this working oil, the locking member 26 can be removed from the locking recess, thus releasing the lock.

[Connecting Bolt]

Figure 3:
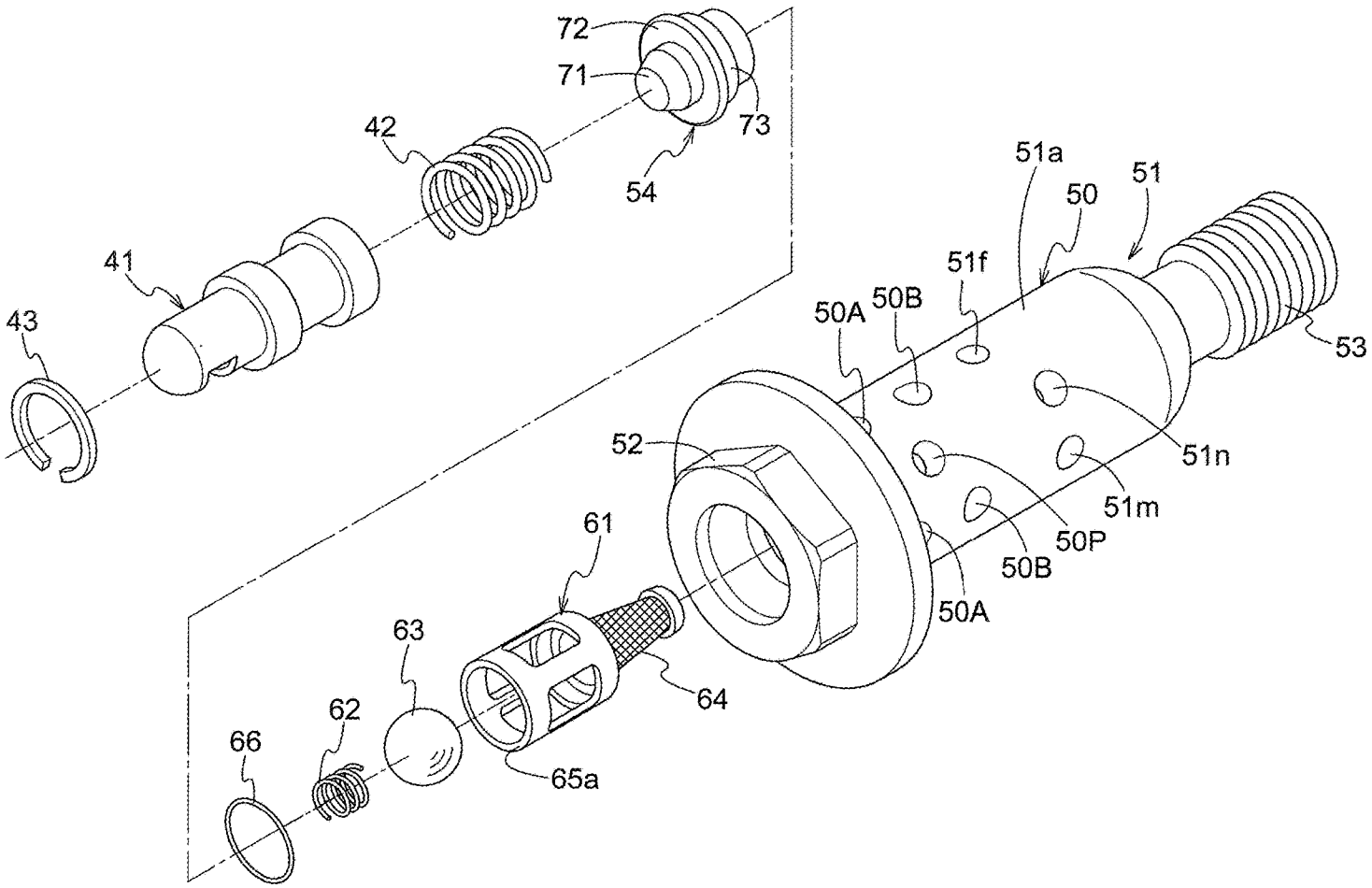
FIG. 3 is an exploded perspective view of a bolt having a fluid control valve.
Figure 4:
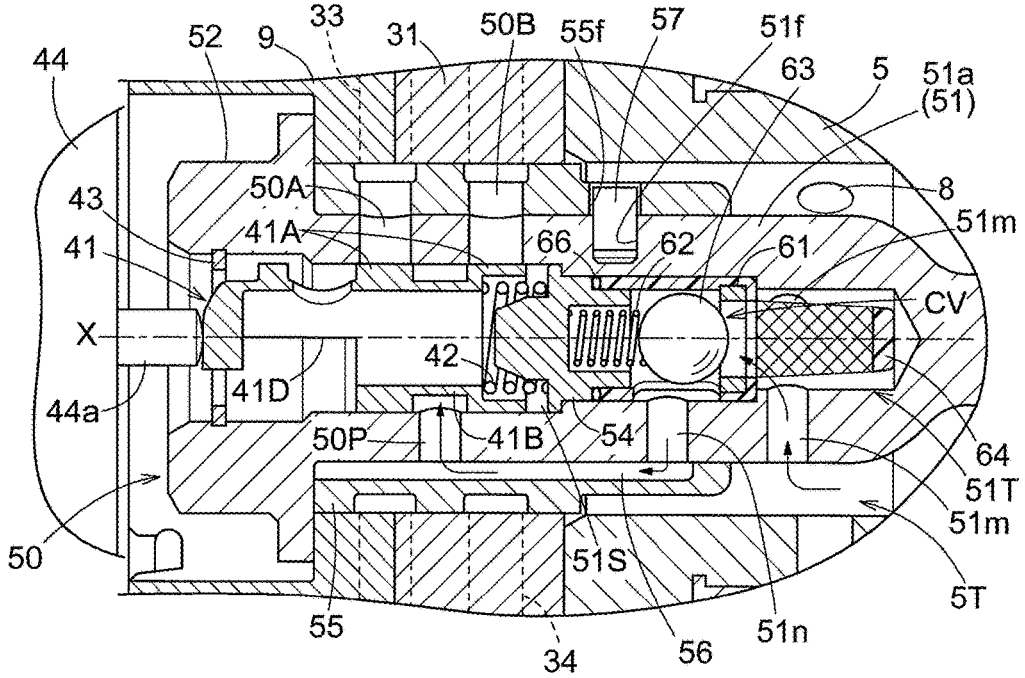
FIG. 4 is a section view showing a bolt member and a passage formed around its circumference.

As shown in FIG. 1 and FIGS. 3-4, the connecting bolt 50 includes a bolt main body 51 formed cylindrical at a part thereof, a cylindrical sleeve 55 to be fitted externally on the cylindrical portion 51*a* of the bolt main body 51, and an engaging pin 57 as an engaging member for fixing the above members in position.

The intake cam shaft 5 defines a female thread portion 5S centered about the rotational axis X and defines also a shaft inner space 5T having a larger diameter than the female thread portion 5S for allowing gapless engagement thereto by the sleeve 55. The shaft inner space 5T is communicated to the feed passage 8 described above, thus being fed with the working oil from the hydraulic pump P.

At the outer end portion of the bolt main body 51 the bolt head portion 52 is formed and at the inner end portion thereof, a male thread portion 53 is formed. With this arrangement, the male thread portion 53 of the bolt main body 51 will be threaded to the female thread portion 5S of the intake cam shaft 5, and then with a rotational operation on the bolt head portion 52, the inner rotor 30 will be fastened to the intake cam shaft 5. Under this fastened state, the inner end side (male thread side) of the outer circumference of the sleeve 55 fitted externally on the bolt main body 51 is placed in gapless contact with the inner circumferential face of the shaft inner space 5T and also the outer end side (bolt head side) thereof is placed in gapless contact with the inner circumferential face of the inner rotor main body 31.

Inside the bolt main body 51, there is formed a bore-like cylindrical portion 51*a* extending from the bolt head portion 52 toward the female thread portion 53 (in the direction of the rotational axis X) And, into this cylindrical portion 51*a*, a retainer 54 (an example of a "partitioning body") is pressure-fitted and fixed. This retainer 54 sections the cylindrical portion 51*a* into a spool chamber 51S and a working oil chamber 51T as a fluid chamber.

[Electromagnetic Control Valve]

As shown in FIG. 4, the electromagnetic control valve 40 includes the spool 41, the spool spring 42, and the electromagnetic solenoid 44.

The bolt main body 51 defines, as through holes, a pair of pump ports 50P that communicate the spool chamber 51S to the outer circumferential face of the bolt main body 51. Further, the connecting bolt 50 defines a plurality of advancing ports 50A and a plurality of retarding ports 50B communicating the spool chamber 51S to the outer circumferential face of the sleeve 55, as through holes extending between the bolt main body 51 and the sleeve 55.

The advancing ports 50A, the pump port 50P and the retarding ports 50B are formed in this mentioned order from the outer end side to the inner end side of the connecting bolt 50. Further, as viewed in the direction along the rotational axis X, the advancing ports 50A and the retarding ports 55B are formed at positions overlapped with each other, and the pump port 50P is formed at a position not overlapped therewith.

In the outer circumference of the sleeve 55, there is formed an annular groove communicated to the plurality of advancing ports 50A, to which the plurality of advancing passages 33 are communicated. Similarly, in the outer circumference of the sleeve 55, there is formed an annular groove communicated to the plurality of retarding ports 50B, to which the plurality of retarding passages 34 are communicated. Further, in the inner circumferential face of the sleeve 55, there is formed, as a groove, an introducing passage 56 configured to establish communication between an intermediate passage 51*n* and the pump port 50P.

Namely, the sleeve 55 is dimensioned to extend from the bolt head portion 52 of the bolt main body 51 to reach the intermediate passage 51*n*, and the introducing passage 56 is formed in a region bypassing (avoiding) the advancing ports 50A and the retarding ports 50B.

The bolt main body 51 forms a first engaging portion 51*f* in the form of a recess at a position off the pressure-fitting/fixing position of the retainer 54 in the direction along the rotational axis X. The sleeve 55 forms a second engaging portion 55*f* in the form of a hole extending therethrough in the radial direction. And, between the first engaging portion 51*f* and the second engaging portion 55*f*, an engaging pin 57 capable of engaging both of these is provided.

With the engagement between the engaging portions 51*f*, 55*f* and the engaging pin 57, the relative rotational phase posture between the bolt main body 51 and the sleeve 55 about the rotational axis X and the relative position thereof in the direction along the rotational axis X are determined, With this, the working oil from the working oil chamber 51T can be fed to the pump port 50P via the introducing passage 56.

The spool 41 forms, on its outer end side, a contact face which contacts the plunger 44*a* and also forms rand portions 41A at two positions in the direction along the rotational axis X. At a mid position between these rand portions 41A, a groove portion 416 is formed. The spool 41 is formed hollow, with a drain hole 41D formed at a protruding end of the spool 41. Further, as it comes into contact with a stopper 43 provided in an inner circumference of the opening on the outer end side of the connecting bolt 50, the protruding side position is determined.

The electromagnetic control valve 40 is configured such that as the plunger 44*a* is brought into contact with the contact face of the spool 41 to control the protrusion amount, the spool 41 can be set to a neutral position, a retarding position, or an advancing position.

By setting the spool 41 to the neutral position shown in FIG. 4, the advancing ports 50A and the retarding ports 50B are closed by the pair of rand portions 41A of the spool 41. As a result, no feeding/discharging of working oil to/from the advancing chambers Ca and the retarding chambers Cb is effected, so that the position of the valve opening/closing timing control apparatus A is maintained.

By the control of the electromagnetic solenoid 44, the plunger 44*a* is retracted (operated to the outer side) relative to the neutral position (FIG. 4). With this, the spool 41 is set to the advancing position. At this advancing position, the pump port 50P is communicated to the advancing port 50A via the groove portion 41B. Simultaneously, the retarding port 50B is communicated to the spool chamber 51S from the inner end of the spool 41. With this, the working oil is fed to the advancing chamber Ca and the working oil flows from the retarding chamber Cb inside the spool 41 and then is discharged through the drain hole 41D. As a result, the rotational phase of the intake cam shaft 5 is displaced in the advancing direction Sa.

Incidentally, when the lock mechanism L is under the locking state, the spool 41 is set to the advancing position and when the working oil is fed into the advancing passage 33, this working oil is fed from the advancing passage 33 into the locking recess of the lock mechanism L, thereby to detach the locking member 26 from the locking recess, whereby the locking state of the lock mechanism L is released.

By the control of the electromagnetic solenoid 44, the plunger 44*a* is protruded (operated to the inner side) relative to the neutral position (FIG. 4). With this, the spool 41 is set to the retarding position. At this retarding position, the pump port 50P is communicated to the retarding port 50B via the groove portion 41B. Simultaneously, when the working oil is fed into the retarding chamber Cb for communicating the advancing port 50A to the drain space (the space continuous on the outer end side from the spool chamber 51S), simultaneously therewith, the working oil is discharged from the advancing chamber Ca. As a result, the rotational phase of the intake cam shaft 5 is displaced in the retarding direction Sb. Incidentally, the advancing position is in agreement with a position where the spool 41 comes into contact with the stopper 43 by the urging force of the spool spring 42.

The spool chamber 51S is formed like a cylinder inner face and the above-described spool 41 is accommodated therein to be movable back and forth along the rotational axis X. Between the inner end of the spool 41 and the retainer 54, the spool spring 42 is disposed, With this, the spool 41 is urged to protrude in the direction of the outer end side (the direction of the bolt head portion 52).

As shown in FIG. 4, in the bolt main body 51, there are formed a plurality of 2) acquisition passages 51*m* for communicating the working oil chamber 51T to the shaft inner space 5T, and also between the working oil chamber 51T and the outer circumferential face of the bolt main body 51, there are formed the plurality of intermediate passages 51*n*.

Figure 5:
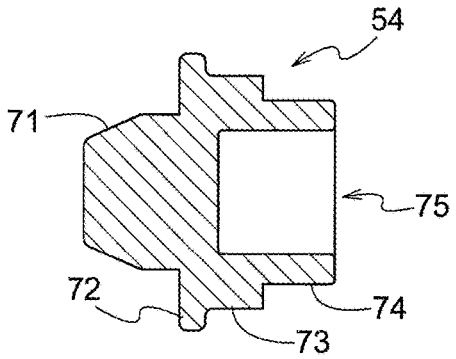
FIG. 5 is a section view of a partitioning body.
Figure 6:
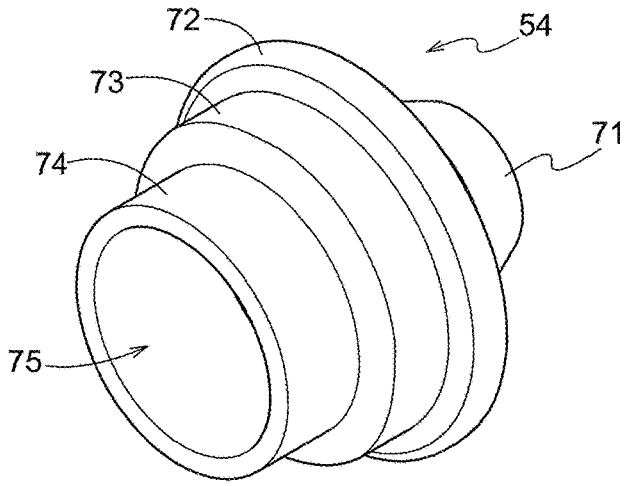
FIG. 6 is a perspective view of the partitioning body.
Figure 7:
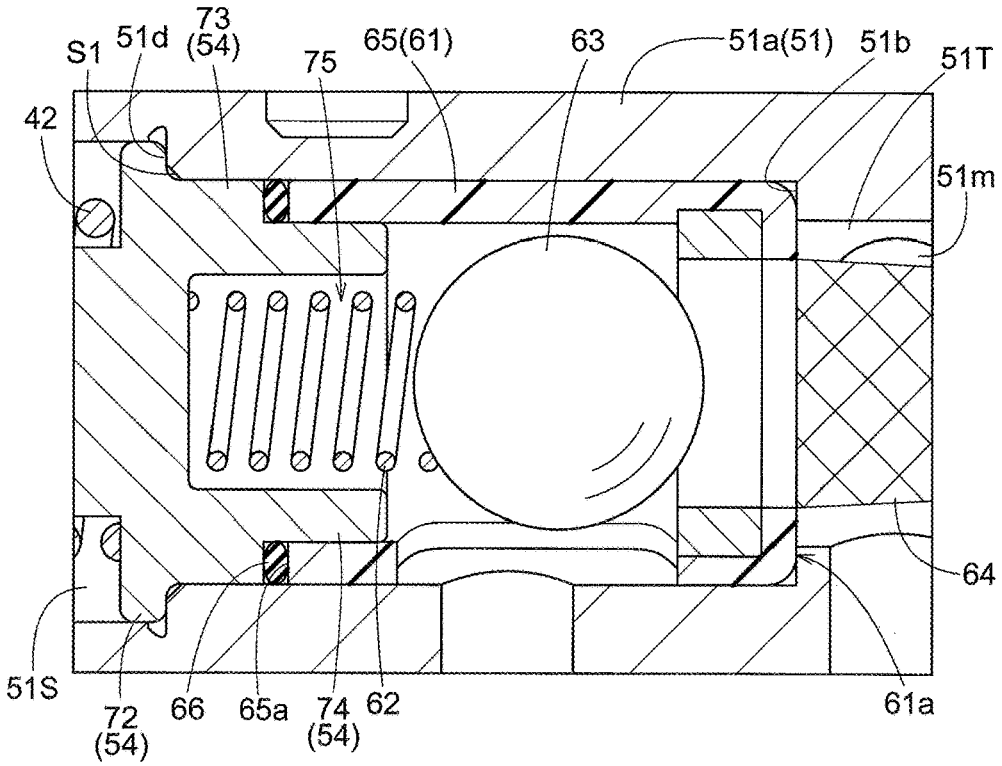
FIG. 7 is a section view showing an arrangement providing an urging portion on a downstream side of a valve accommodating body.

As shown in FIGS. 5 through 7, the retainer 54 includes, in the order from the spool chamber 51S side, a retaining portion 71, a flange 72, a press-in portion 73, and an engaging portion 74. The retaining portion 71 protrudes from the flange 72 toward the spool chamber 51S to retain the spool spring 42. In the cylindrical portion 51*a*, a stepped portion 51*d* is provided at the boundary between the spool chamber 51S and the working oil chamber 51T and to this stepped portion 51*d*, the flange 72 comes into contact. The press-in portion 73 is to be pressure-inserted into the inner circumferential face of the cylindrical portion 51*a* The engaging portion 74 comes into engagement with a ball holder (an example of "valve accommodating body") 61 of the valve body to be described later.

In the working oil chamber 51T, a passage which feeds the working oil from the acquisition passage 51*m* to the intermediate passage 51*n* incorporates a check valve CV. This check valve CV is constituted of the ball holder 61 (an example of the "valve accommodating body"), a check spring 62 and a check ball 63 (an example of a "valve body"). The check ball 63 regulates the flow direction of the working oil relative to the fluid pressure chamber C.

The retainer 54 includes a bore portion 75 opened to the side of the working oil chamber 51T and formed along the rotational axis X, Between the bore portion 75 of the retainer 54 and the check ball 63, the check spring 62 is disposed. Under an urging force of the check spring 62, the check ball 63 is brought into pressure-contact with the opening of the ball holder 61, thus closing the passage. In the ball holder 61, there is provided an oil filter 64 for removing dust or the like from the working oil flowing toward the check ball 63.

As shown in FIG. 7, the ball holder 61 is opened toward the spool chamber 51S and an end portion on the side of the spool chamber 51S is constituted as an engaged portion 65 to be externally engaged with the engaging portion 74 of the retainer 54. The ball holder 61 is formed of e.g. a resin material. In the ball holder 61, its spool chamber 51S side faces the press-in portion 73 of the retainer 54 and its working oil chamber 51T side faces the stepped portion 51*b* of the cylindrical portion 51*a*. Namely, the position of the ball holder 61 is regulated by the press-in portion 73 and the stepped portion 51*b*. Between the press-in portion 73 and the engaged portion 65, an O-ring 66 is provided. This O-ring 66 is formed of an elastic material and generates a repulsive force between the press-in portion 73 (an example of "an other object that regulates a position of the valve accommodating body") and the ball holder 61. Exposed to the repulsive force of the O-ring 66, the end portion 61*a* on the side of the working oil chamber 51T of the ball holder 61 is pressed against the stepped portion 51*b*. In this way, by the O-ring 66, the position of the ball holder 61 in the direction of the rotational axis X is maintained.

As the ball holder 61 comes into contact with the stepped portion 51*b* of the bolt main body 51, thus providing sealing, leak of the working oil via a gap between the bolt main body 51 and the ball holder 61 can be prevented. Incidentally, assembly of the check valve CV to the bolt main body 51 is effected with insertion into the cylindrical portion 51*a* of the check valve CV with the O-ring 66 and the ball holder 61 being attached to the retainer 54.

Since the gap relative to the cylindrical portion 51*a* is sealed by the end portion 61*a* of the ball holder 61, the gap relative to the cylindrical portion 51*a* need not be sealed by the O-ring 66. When the retainer 64 is to be pressed into the bolt main body 51, depending on its radial size, the inner face of the bolt main body 51 may be shaved to generate foreign material. For this reason, if a space is formed between the inner circumferential face of the cylindrical portion 61*a* and the O-ring 66 for instance, it becomes possible to entrap such foreign material in this space, so that outflow of the foreign material into the passage can be prevented.

Such foreign material that can be generated at the time of pressing of the retainer 54 into the bolt main body 51 can be generated on the spool chamber 51S side which is the near side in the inserting direction of the press-in portion 73, For this reason, a space S1 acting as foreign material trap is formed between the stepped portion 51*d* provided at the boundary between the spool chamber 51S and the working oil chamber 51T and the radial base portion of the flange 72 of the retainer 54. And, this space S1 is extended by chamfering of a corner portion of the stepped portion 51*d*. With this, foreign material generated on the near side in the inserting direction of the press-in portion 73 can be entrapped within the space S1 thus outflow of foreign material into the passage can be prevented.

The check valve CV opens up the passage against the urging force of the check spring 62 in case the pressure of the working oil fed to the working oil chamber 51T exceeds a predetermined value and closes the passage by the urging force of the check spring 62 in case the pressure drops below the predetermined value. With this operation, reverse flow of working oil from the advancing chamber Ca or the retarding chamber Cb at the time of working oil pressure reduction is suppressed, thus preventing displacement of the phase of the valve opening/closing timing control apparatus A. Further, the check valve CV effects the closing operation also when a downstream side pressure of this check valve CV exceeds the predetermined value.

[Second Embodiment]

Figure 8:
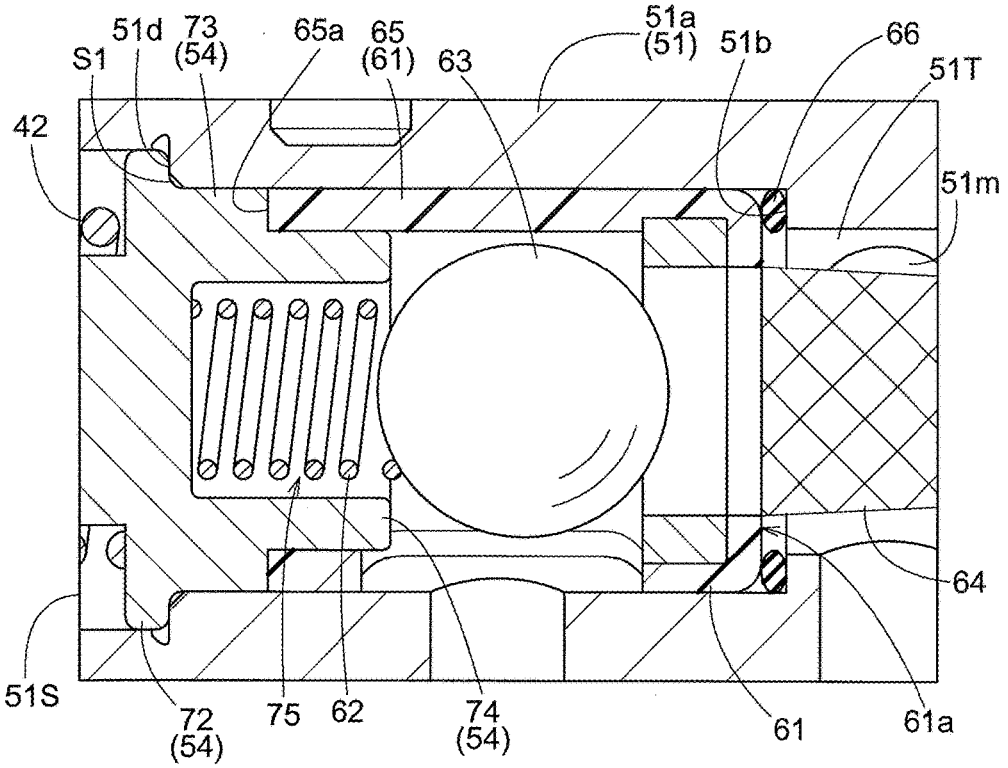
FIG. 8 is a section view showing an arrangement providing an urging portion on an upstream side of the valve accommodating body.

In the first embodiment, there was shown an example in which the O-ring 66 is provided between the press-in portion 73 and the end portion 65*a* of the engaged portion 65. In this embodiment, as shown in FIG. 8, the O-ring 66 is provided between the end portion 61*a* of the ball holder 61 and the stepped portion 51*b* formed on the side of the working oil chamber 51T. In this case, the O-ring 66 generates a repulsive force between the stepped portion 51*b* (an example of "an other object that regulates a position of the valve accommodating body") and the ball holder 61. As the ball holder 61 is exposed to the repulsive force of the O-ring 66, the end portion 65*a* on the side of the spool chamber 51S is pressed against the press-in portion 73 of the retainer 54. In this way, by the O-ring 66, the position of the ball holder 61 in the direction of the rotational axis X is maintained.

Incidentally, in order to prevent introduction of the working oil through the gap between the ball holder 61 and the cylindrical portion 51*a*, it is necessary to reliably seal between the ball holder 61 and the cylindrical portion 51*a* by the O-ring 66.

[Other Embodiments]

(1) In the foregoing embodiment, there was shown an example in which the O-ring 66 is provided on one of the upstream side (the side of the working oil chamber 51T) and the downstream side (the side of the spool chamber 51S) of the ball holder 61. Instead, the O-ring 66 can be disposed on both of the upstream side and the downstream side of the ball holder 61.

Figure 9:
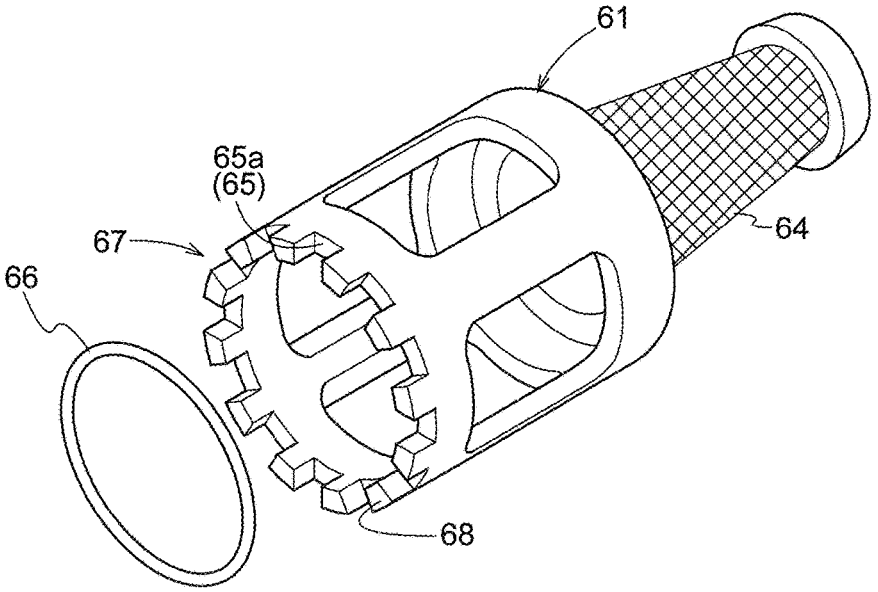
FIG. 9 is a perspective view of a valve accommodating body in a further embodiment.

(2) In the foregoing embodiment, there was shown an example in which a flat face portion of the ball holder 61 comes into contact with the O-ring 66. Instead, as shown in FIG. 9, an annular portion (part) 65*a* of the ball holder 61 that comes into contact with the O-ring 66 can include a concave/convex portion 67 formed continuous along the circumferential direction.

If the end portion 65*a* of the ball holder 61 includes such concave/convex portion 87, face pressure of convex portions 68 of the concave/convex portion 67 is increased, so that these convex portions 68 will be pressed deep into the O-ring 66. In this way, by varying the deformation amount of the O-ring 66 by the annular portion, the elastic force of the O-ring 66 can be effectively utilized. As a result, the repulsive force of the O-ring 66 can be transmitted effectively to the ball holder 61, so that the retaining force for the ball holder 61 by the O-ring 66 can be enhanced. Further, with appropriate variation of the shape of the concave/convex portion 67, the repulsive force of the O-ring 66 to the ball holder 61 can be easily adjusted.

Incidentally, in the above-described arrangement, a gap will be formed between the end portion 65*a* and the O-ring 66. So, the working oil will pass therebetween. Thus, is preferred that a sealing portion for the working oil be additionally provided, such as provision of a further O-ring between the inner face of the cylindrical portion 51*a* and the press-in portion 73.

Figure 10:
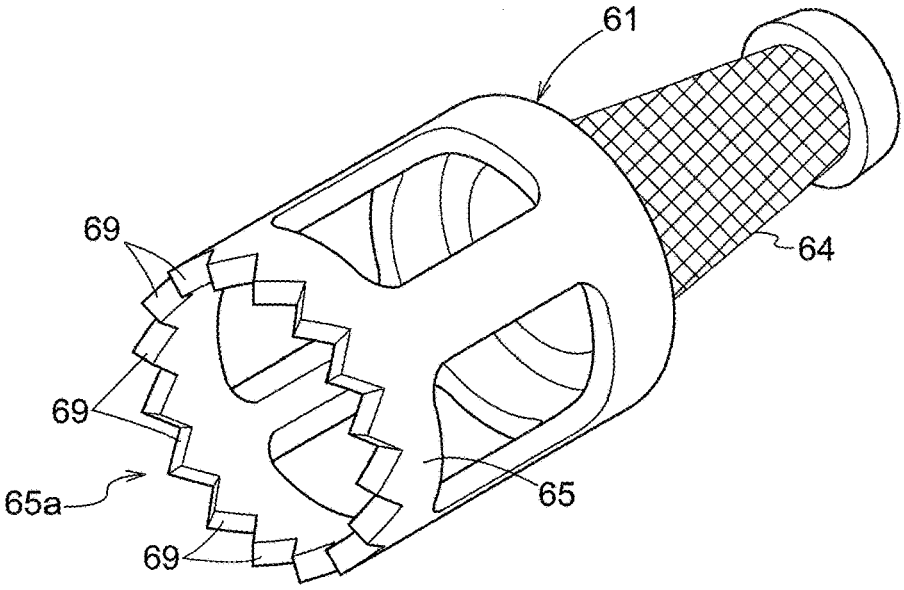
FIG. 10 is a perspective view of a valve accommodating body in a still further embodiment.
Figure 11:
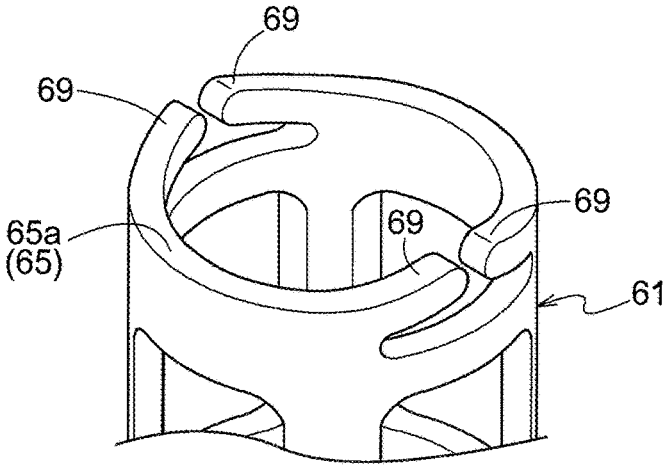
FIG. 11 is a perspective view of a valve accommodating body in a still further embodiment.

(3) In the foregoing embodiment, there was shown an example in which the O-ring 66 separate from the ball holder 61 is provided as an urging portion. Instead, such urging portion can be a convex portion that is formed integral with a part of the ball holder 61 and that is deformed due to its contact with the press-in portion 73 of the retainer 54 or the stepped portion 51*b* of the cylindrical portion 51*a*. FIG. 10 shows an example in which many tapered convex portions 69 are provided at the end portion 65*a* of the ball holder 61. FIG. 11 shows an example in which there are provided bar-like convex portions 69 that extend to positions opposed to each other in the circumferential direction and protrude in the direction of the rotational axis X. By forming the urging portion integrally at a portion of the ball holder 61, readiness of assembly to the flow passage space formed in the bolt main body 51 is improved. In the arrangements shown in FIG. 10 and FIG. 11 also, additional O-ring can be provided e.g. at the gap between e.g. the inner face of the cylindrical portion 51*a* and the press-in portion 73.

In the above-describe case also of forming the convex portion 69 as an urging portion integrally at a part of the ball holder 61, similarly to the case of the urging portion being the O-ring 66, such convex portion 69 will be provided on at least one of the upstream side (the side of the working oil chamber 51T) and the downstream side (the side of the spool chamber 51S) of the ball holder 61.

From the foregoing embodiment, the valve opening/closing timing control apparatus can be configured as follows.

According to a characterizing feature of a valve opening/closing timing control apparatus relating to this disclosure, the apparatus comprises:

a driving-side rotary body that is rotated in synchronism with a crank shaft of an internal combustion engine;

a driven-side rotary body that is disposed coaxially with a rotational axis of the driving-side rotary body and that is rotated in synchronism with a cam shaft of the internal combustion engine;

a fluid pressure chamber formed between the driving-side rotary body and the driven-side rotary body, and configured to change a relative phase between the driving-side rotary body and the driven-side rotary body by feeding/discharging of working fluid;

a bolt member having a tubular portion that forms a passage for feeding/discharging the working fluid to/from the fluid pressure chamber and that is disposed inside the driven-side rotary body, the bolt member connecting the driven-side rotary body and the cam shaft; and a valve body and a valve accommodating body that are disposed inside the tubular portion, the valve body being configured to regulate a flow direction of the working fluid relative to the fluid pressure chamber, the valve accommodating portion being configured to accommodate the valve body;

wherein at least on one of an upstream side and a downstream side of the valve accommodating body, there is provided an urging portion for generating a repulsive force between an other object that regulates a position of the valve accommodating body and the valve accommodating body.

With the above configuration, since at least on one of an upstream side and a downstream side of the valve accommodating body, there is provided an urging portion for generating a repulsive force between an other object that regulates a position of the valve accommodating body and the valve accommodating body, the valve accommodating body as exposed to the repulsive force from the urging portion is pressed against and thus fixed to the other object on the side opposite this urging portion. With this, wobbling of the valve accommodating body in the passage of the bolt member can be prevented.

Further, as the valve accommodating body is held in a stable manner to the bolt member by means of the urging portion, sealing of the valve accommodating body relative to the inner face of the bolt member can be maintained easily, so that leakage of working fluid via a gap between the bolt member and the valve accommodating body can be prevented.

Moreover, with the stable holding of the valve accommodating body by the bolt member, it is also possible to prevent generation of noise from the valve accommodating body due to flow ripple of the working fluid and wear and damage of the valve accommodating body.

According to a further characterizing feature, the urging portion comprises an O-ring formed of elastic material.

The other object that regulates a position of the valve accommodating body in the inner face of the bolt member is provided normally in the circumferential direction surrounding the passage. Therefore, if the urging portion comprises an O-ring formed of elastic material as provided by the above characterizing feature, the urging portion can be readily disposed between the other object that regulates a position of the valve accommodating body and the valve accommodating body. Further, if the urging portion is constituted of an O-ring as a member separate from the valve accommodating body, degree of freedom in selection of a size of the urging portion and an elastic material for forming this urging portion is increased.

According to a still further characterizing feature, an annular portion of the valve accommodating body which portion comes into contact with the O-ring has a convex/concave portion that is formed continuous in the circumferential direction.

If an annular portion of the valve accommodating body which portion comes into contact with the O-ring has a convex/concave portion that is formed continuous in the circumferential direction, as provided in the above-described feature, the convex portion of the convex/concave portion can provide higher face pressure. Thus, the repulsive force of the O-ring can be transmitted smoothly to the valve accommodating body, whereby the holding force for the valve accommodating body by the O-ring can be enhanced. Further, with appropriate change of the shape of the convex/concave portion, the repulsive force of the O-ring for the valve accommodating body can be easily adjusted.

According to a still further characterizing feature, the urging portion comprises a convex portion that is formed integral with a part of the valve accommodating body and that is deformed by its contact with the other object.

If the urging portion comprises a convex portion that is formed integral with a part of the valve accommodating body and that is deformed by its contact with the other object as provided by the above feature, the position of the valve accommodating body can be maintained by deformation of the convex portion which forms a part of the valve accommodating portion. As the valve accommodating body and the urging portion are formed integral with each other, the number of parts can be reduced and readiness of work of assembling valve constituting members in the flow passage space formed in the bolt member is improved.

The principles, preferred embodiment and mode of operation of the present disclosure have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the sprit and scope of the present invention as defined in the claims, be embraced thereby.

This disclosure is applicable to a valve opening/closing timing control apparatus configured to set a valve opening/closing timing via a fluid pressure.

The invention claimed is:

1. A valve opening/closing timing control apparatus comprising:

a driving-side rotary body that is rotated in synchronism with a crank shaft of an internal combustion engine;

a driven-side rotary body that is disposed coaxially with a rotational axis of the driving-side rotary body and that is rotated in synchronism with a cam shaft of the internal combustion engine;

a fluid pressure chamber formed between the driving-side rotary body and the driven-side rotary body, and configured to change a relative phase between the driving-side rotary body and the driven-side rotary body by feeding/discharging of working fluid;

a bolt member having a tubular portion that forms a passage for feeding/discharging the working fluid to/from the fluid pressure chamber and that is disposed inside the driven-side rotary body, the bolt member connecting the driven-side rotary body and the cam shaft;

a valve body and a valve accommodating body that are disposed inside the tubular portion, the valve body being configured to regulate a flow direction of the working fluid relative to the fluid pressure chamber, the valve accommodating portion being configured to accommodate the valve body;

a retainer that regulates a position of the valve accommodating body;

an urging portion that urges the valve accommodating body;

the tubular portion comprising a stepped portion that includes a radial base portion; and a space between the radial base portion and the retainer.

2. The valve opening/closing timing control apparatus according to claim 1, wherein the urging portion comprises an O-ring formed of elastic material.

3. The valve opening/closing timing control apparatus according to claim 2, wherein an annular portion of the valve accommodating body contacts the O-ring and includes a convex/concave portion that is continuous in the circumferential direction.

4. The valve opening/closing timing control apparatus according to claim 1, wherein the urging portion comprises a convex portion integral with a part of the valve accommodating body and deformable by contact of the convex portion with the other object.

* * * * *